United States Patent [19]

McKinnon

[11] 4,109,179

[45] Aug. 22, 1978

[54] MICROWAVE TUBE ASSEMBLY

[75] Inventor: John J. McKinnon, East Falmouth, Mass.

[73] Assignee: Raytheon Company, Lexington, Mass.

[21] Appl. No.: 756,301

[22] Filed: Jan. 3, 1977

[51] Int. Cl.[2] ..... H01J 25/587

[52] U.S. Cl. ..... 315/39.75; 315/39.51; 315/39.65; 29/25.1

[58] Field of Search ..... 315/39.75, 39.65, 39.51; 29/25.1, 25.11

[56] References Cited

U.S. PATENT DOCUMENTS

| | | | |
|---|---|---|---|
| 2,548,808 | 4/1951 | Nichols | 315/39.75 |
| 2,626,372 | 1/1953 | Spencer | 315/39.75 X |
| 2,843,800 | 7/1958 | Marie | 315/39.65 X |
| 2,852,720 | 9/1958 | Crapuchettes | 315/39.75 |

*Primary Examiner*—Saxfield Chatmon, Jr.
*Attorney, Agent, or Firm*—M. D. Bartlett; J. D. Pannone

[57] ABSTRACT

A microwave magnetron having an anode assembly formed of a plurality of vanes contacting an anode cylinder and extending inwardly toward a central region containing an electron source in which the anode vanes have notches adjacent the anode cylinder into which retaining rings have been deformed to maintain the vanes in a spaced peripheral location in firm metallic contact with the anode cylinder and with the assembly brazed together by heating the assembly with a plurality of straps contacting alternate vanes adjacent their inner ends to form a unitary electrically conductive anode resonator.

10 Claims, 4 Drawing Figures

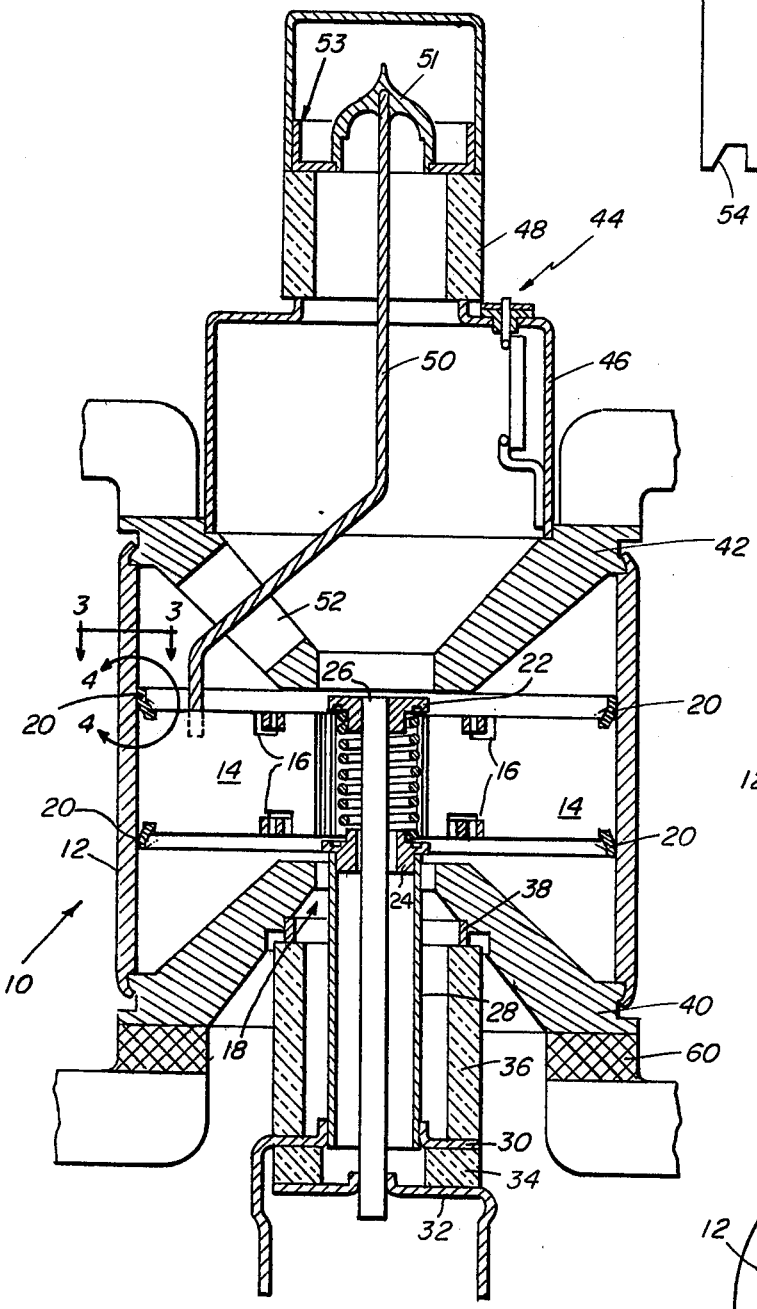
FIG. 1
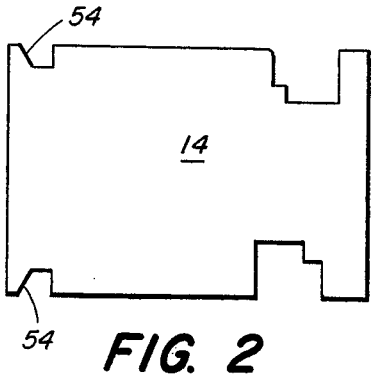
FIG. 2
FIG. 3
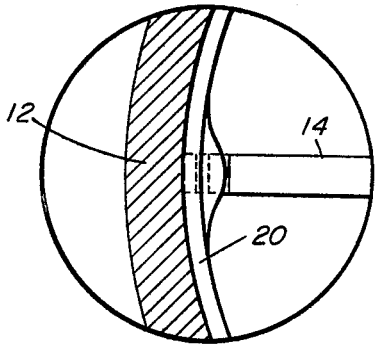
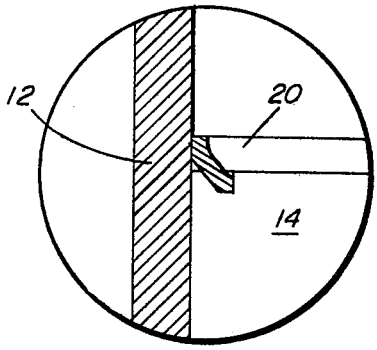
FIG. 4

MICROWAVE TUBE ASSEMBLY

BACKGROUND OF THE INVENTION

In the production of magnetrons, it has been the practice to space anode vanes peripherally around the interior of an anode cylinder by forming longitudinal grooves on the inner surface of the anode cylinder to position the vanes and to hold the vanes in position in a jig fixture while they were brazed to the anode cylinder. Such process required a relatively thick wall anode cylinder to provide material for the grooves and required a relatively expensive brazing procedure to ensure that the anode members firmly contacted the anode cylinder and provided for brazing fillets at the junction of the anode vanes and the anode cylinder. Such electrical contacts are particularly important for magnetron structures since heavy oscillating currents traverse the junctions between the vanes and the anode cylinder at the microwave frequencies generated by the magnetrons.

SUMMARY OF THE INVENTION

This invention provides for a magnetron having an anode structure in which the vanes are formed in contact with the inner surface of a smooth bore anode cylinder which may have a wall thickness substantially less than that of previous anode wall cylinders.

More specifically, the invention provides for an anode assembly in which the vanes extending from the inner surface of the anode cylinder have been held in place by keeper rings formed concentric with the anode cylinder and having an initial outer diameter slightly less than the inner diameter of the anode cylinder and deformed into notches in the upper and lower edges of the vanes adjacent the anode cylinder. More specifically, the notches have slopes which extend from positions adjacent the anode cylinder into the anode vanes so that pressure on the retaining ring causes a radial outward pressure on the vanes to firmly hold the vanes against the inner surface of the anode cylinder.

This invention further provides that the inner ends of the vanes have sets of straps which contact alternate vanes and that such straps are pressed into notches in the vanes with an interference fit prior to brazing so that the inner ends of the vanes are held relatively without motion while the anode assembly is brazed.

BRIEF DESCRIPTION OF THE DRAWINGS

Other and further objects and advantages of the invention will be apparent as the description thereof progresses, reference being had to the accompanying drawings wherein:

FIG. 1 shows a vertical sectional view of a magnetron embodying the invention;

FIG. 2 shows a view of an anode vane for the magnetron illustrated in FIG. 1;

FIG. 3 shows a detail of the retaining ring structure shown in FIG. 1; and

FIG. 4 shows an expanded view of a detail of the structure shown in FIG. 1.

DESCRIPTION OF THE PREFERRED EMBODIMENT

Referring now to FIGS. 1–4, there is shown a magnetron 10 comprising an anode cylinder 12 having a plurality of inwardly extending vanes 14 whose inner ends are alternately interconnected by straps 16 in accordance with well-known practice and whose outer ends have been retained against the inner surface of cylinder 12 during construction by rings 20 in a manner to be described presently.

Positioned in the space defined by the inner ends of the vanes 14 is a cathode 18, for example, of a spirally coiled directly heated filament of thoriated tungsten connected at its upper and lower ends to end shields 22 and 24, respectively. Upper end shield 22 is connected to a metal central support lead 26, and lower end shield 24 is connected to a metal cylinder 28. Cylinder 28 is connected to a metal lead-in washer 30, which is rigidly connected to a lead-in washer 32 through an insulating washer 34 of, for example, ceramic material said washer 32 is also connected to metal rod 26 to provide an electrical connection thereto. Washer 30 is also connected through a high voltage insulating cylinder 36 surrounding cylinder 28 and bonded to a metal ring 38 which in turn is bonded to a lower magnetic pole piece 40 bonded to anode cylinder 12 and having an aperture through which the cathode assembly 18 is supported in the interaction space adjacent the inner ends of vanes 14. An upper pole piece 42 is sealed to the upper end of cylinder 12.

An output structure 44 extends upwardly from pole piece 42 and comprises a metal cylinder 46 sealed to pole piece 42 and sealed to an output microwave window cylinder 48. An output antenna 50 is connected to the upper edge of one of the vanes 14 and extends through an aperture 52 in pole piece 42 and through cylinder 46 and output window cylinder 48 to be held in place by a glass tubulation tip 54 through which the magnetron has been evacuated and sealed. Tubulation tip 54 is covered by a metal cup bonded to tubulation tip 54. A magnetic field is applied between pole pieces 40 and 42 by a conventional permanent magnet structure 60 which may comprise an annular permanent magnet with a magnetic return path.

DESCRIPTION OF THE PREFERRED METHOD

Assembly of vanes 14 in cylinder 12 preferably uses rings 20 made, for example, of copper which are urged into sloped notches 54 formed in the upper and lower corners of the vanes 14. The retaining rings 20 are permitted to deform slightly as they are pushed down the slopes of the notches 54 so that the edge of the rings 20 bearing against the notch moves radially inwardly while the opposite edge of the ring is retained in its original radial position, for example, by a die (not shown). Since both the vane and the ring are preferably of the same material, such as copper, they will both partially deform at their interface under pressure. The straps 16 have then inserted into the notches adjacent the inner ends of the vanes 14.

The retaining rings 20 have preferably been formed with their outer diameters slightly smaller than the inner diameter of the anode cylinder 12 so that they may be easily inserted therein. However under the pressure used to force the rings 20 into the notches 54, the rings 20 expand radially and become an interference fit with the anode cylinder 12 so that axial movement of the vanes 14 in the cylinder 12 is prevented after the assembly. In addition, the straps 16 preferably are a slight interference fit with the sides of the notches which they engage so that when pressed in place, they are firmly retained during the subsequent brazing process and may also assist in preventing circumferential movement of the inner ends of the vanes.

The anode assembly, which included antenna 50 crimped to one of the vanes, is then brazed by heating in an oven in an inert atmosphere with a brazing compound as one of the silver brazing compounds. Preferably, the vanes 14 have been previously flash coated with the brazing compound and a ring of the compound, which is placed on the upper retaining ring 20, flows downwardly onto the surface of the vanes 14 and into the corners between the vanes 14 and the interior surface of the anode cylinder 12 to produce smooth fillets.

Such an anode has good electrical conductivity, while having substantially less weight than previous magnetron anodes. For example, 1 kilowatt microwave magnetron can have an anode wall thickness of 0.060 inches which is less than one third of its previous anode wall thickness. In addition, the matches 54 in vanes 14, give the vanes a "fishtail" shape which aids in automatic machine assembly of the anode structure.

This completes the description of the embodiments of the invention illustrated herein. However, many modifications thereof will be apparent to persons skilled in the art without departing from the spirit and scope of this invention. For example, the retaining rings can be used to retain anode vanes in assemblies which are to be welded, for example, with electron on laser beams, and the invention could be used to form anodes for magnetrons on other tubes having different cathodes and filament structures from those shown. Accordingly, it is intended that this invention be not limited to the particular details illustrated herein except as defined by the appended claims.

What is claimed is:

1. A microwave magnetron comprising:

an anode cylinder having end walls connected thereto;

a plurality of anode vanes extending inwardly from the interior surface of said anode cylinder spaced from said end walls; and a plurality of retainer rings formed into recesses in said vanes and said rings urging said anode vanes against said inner surface of said anode cylinder.

2. The microwave magnetron in accordance with claim 1 wherein:

said anode vanes are brazed to said anode cylinder.

3. The microwave magnetron in accordance with claim 1 wherein:

the inner ends of said vanes define a plenum containing an electron source.

4. A microwave magnetron comprising:

an anode cylinder having end walls connected thereto;

a plurality of anode vanes extending inwardly from the interior surface of said anode cylinder spaced from said end walls;

a plurality of retainer rings formed into recesses in said vanes and said rings urging said anode vanes against said inner surface of said anode cylinder; and the inner ends of said anode vanes being alternately interconnected by conductive straps.

5. A microwave magnetron comprising:

an anode cylinder having end walls connected thereto;

a plurality of anode vanes extending inwardly from the interior surface of said anode cylinder spaced from said end walls;

a plurality of retainer rings formed into recesses in said vanes and said rings urging said anode vanes against said inner surface of said anode cylinder; and said recesses being formed in the upper and lower edges of said vanes adjacent said anode cylinder.

6. The method of forming a microwave magnetron comprising the steps of:

forming a magnetron anode comprising connecting inwardly extending vanes to an anode cylinder by positioning an end of each of said vane adjacent an inner surface of said anode cylinder and locking said vanes in place by urging retaining rings into recesses in the edges of said vanes; and assembling said magnetron with an electron source in the space defined by the inner ends of said vanes.

7. The method in accordance with claim 6 wherein:

said step of forming said anode comprises brazing said vanes to anode cylinder after said anode vanes have been retained by said retaining rings.

8. The method in accordance with claim 6 wherein:

said step of forming said magnetron anode comprises alternately contacting the inner ends of said vanes with anode straps.

9. The method in accordance with claim 6 wherein:

said step of forming said anode comprises producing radial deformations of said retaining rings.

10. The method in accordance with claim 9 wherein:

said step of producing radial deformations of said retaining rings comprises deforming the portions of said rings contacting said vanes radially inwardly along slopes in said vanes; and deforming other portions of said rings radially outwardly to firmly engage the inner surface of said anode.

* * * * *